US007219515B2

(12) United States Patent
Ravenstein

(10) Patent No.: US 7,219,515 B2
(45) Date of Patent: May 22, 2007

(54) EARRING HAVING ATTACHABLE ACCESSORY

(76) Inventor: John Ravenstein, 4500 1-55 North, Highland Village, Suite 190, Jackson, MS (US) 39211

( * ) Notice: Subject to any disclaimer, the term of this patent is extended or adjusted under 35 U.S.C. 154(b) by 0 days.

(21) Appl. No.: 10/299,336

(22) Filed: Nov. 19, 2002

(65) Prior Publication Data

US 2004/0093899 A1 May 20, 2004

(51) Int. Cl.
*A44C 7/00* (2006.01)

(52) U.S. Cl. ..... 63/12; 63/13

(58) Field of Classification Search ..... 63/29.1, 63/1.16, 1.17, 1.18, 40, 12, 13, 14.1–14.9
See application file for complete search history.

(56) References Cited

U.S. PATENT DOCUMENTS 10,921 A * 5/1854 Higgins ..... 63/13
758,848 A * 5/1904 Pejchar ..... 63/12
1,056,414 A * 3/1913 Hexter ..... 63/29.1
2,058,978 A 10/1936 Hamin
2,490,908 A * 12/1949 Kohler ..... 63/14.7
2,509,726 A * 5/1950 Dauvergne ..... 63/1.17
2,600,319 A * 6/1952 Postel ..... 63/29.1
2,797,561 A * 7/1957 Vaughn ..... 63/13
3,180,112 A 4/1965 Lefkowitz
3,443,398 A * 5/1969 King, Jr. ..... 63/13
3,483,716 A 12/1969 Stenzler
3,568,467 A 3/1971 Ellison
3,626,718 A 12/1971 Schneider
4,195,492 A * 4/1980 Johnson ..... 63/12
4,218,894 A * 8/1980 Tropea ..... 63/13
4,265,098 A * 5/1981 Wayne ..... 63/1.16
4,488,415 A 12/1984 Jenkins
4,580,417 A * 4/1986 Sardelli ..... 63/12
4,682,477 A * 7/1987 Vaillancourt ..... 63/12
4,783,974 A * 11/1988 Hernandez ..... 63/1.16
4,796,443 A * 1/1989 Bannister et al. ..... 63/14.5
4,899,556 A * 2/1990 Ford ..... 63/14.1
4,907,424 A * 3/1990 Reinstein et al. ..... 63/12
5,020,338 A * 6/1991 Payne et al. ..... 63/12
5,048,311 A * 9/1991 Mastrobuono ..... 63/12
5,170,641 A * 12/1992 DiDomenico ..... 63/1.17
5,203,183 A 4/1993 Salerno
5,337,584 A * 8/1994 Angeli ..... 63/1.17
5,379,611 A * 1/1995 Impagliazzo ..... 63/14.1
5,392,617 A * 2/1995 Baldwin ..... 63/12
5,438,850 A * 8/1995 Keating et al. ..... 63/20
5,505,061 A * 4/1996 Fleury et al. ..... 63/29.1
5,577,396 A * 11/1996 Cannon ..... 63/13

(Continued)

*Primary Examiner*—Robert J. Sandy
*Assistant Examiner*—David Reese
(74) *Attorney, Agent, or Firm*—Feldman Law Group, PC

(57) ABSTRACT

An earring assembly is described including an earring and an accessory. The earring includes a fastening mechanism and an ornamental portion. The accessory is removably attached with the earring and is configured to corresponding mate with the ornamental portion to enhance and compliment the ornamental appearance of the earring. The accessory is readily removed and replaced by a system of posts that engage catches and lock the accessory in position with the earring. The back of the ornamental portion has posts that mate with notches defined in the catches positioned on the accessory. The ornamental portion also includes a lip. The accessory further includes biasing means augmenting the system of posts and catches to ensure the secure positioning of the accessory against the lip of the ornamental portion of the earring.

17 Claims, 6 Drawing Sheets

U.S. PATENT DOCUMENTS 5,709,013 A * 1/1998 Stanback ..... 24/66.9
5,836,176 A 11/1998 Lichenstein et al.
6,032,486 A 3/2000 Uchin
6,058,737 A * 5/2000 Domagala ..... 63/12
6,131,408 A * 10/2000 Gill ..... 63/15.8
6,209,351 B1 * 4/2001 Zeleny ..... 63/1.16
6,532,766 B1 * 3/2003 Chia et al. ..... 63/26

* cited by examiner

EARRING HAVING ATTACHABLE ACCESSORY

BACKGROUND

1. Technical Field

The present disclosure relates to earrings. More particularly, the present disclosure relates to earrings having at least one attachable accessory.

2. Background of Related Art

Jewelry having additional accessories includes a single replaceable component, interchangeable components, and supplemental components to a permanent setting. The additional components can include costume jewelry or supplemental settings including jewels connected to the earring by mechanisms such as screws into threaded sockets, loops onto wires, biased tongues into sockets, and bias means. These mechanisms strive to bring a balance between providing a secure connection for the additional component and an ease of removing and replacing the components.

A configuration for an earring including removable components is described in U.S. Pat. No. 5,836,176 to Lichtenstein et al. Lichtenstein et al. teaches an ear lobe securing assembly configured as a wire having a terminal end that is secured by a hinge arm when worn. A pin having a loop on one end and a stop on the other is configured for the positioning of the ornamental jewelry. The loop is threaded onto the open end of the wire and is configured to hang freely from the lowest point of the wire. One or more ornamental components can be positioned on the pin between the loop and stop. Lichtenstein et al. is limited in its style of ornamentation by the requirement to thread each component onto the wire. Further, to change the configuration of the Lichtenstein et al. earring is excessively time consuming requiring the steps of taking off the ear of the wearer, disassembled, the pin reassembled with new ornaments, installing the pin back in position on the wire, and positioning the earring in the ear of the wearer.

In U.S. Pat. No. 6,058,737 to Domagala, a closeable loop wire earring is described that enables a supplemental setting gemstone or component to be threaded onto and positioned on the wire. Domagala is constrained, like the Lichtenstein et al. configuration by the necessity for threading the supplemental component along the wire. This also limits the manner and ability of the supplemental component can be positioned relative to a permanent setting.

In U.S. Design Pat. No. 6,131,408 to Gill, a ring having a readily attachable enhancer is described. The enhancer is an additional setting configured for positioning in the vicinity of the primary setting of the ring. The enhancer has a channel type shape configured for being positioned on and at least partially around the inner circumference and sides of the annular surface of the ring below the primary setting. The enhancer has a stem with a bulbous tip positioned in a bottom of the channel configured for positioning into a bore or cavity in the ring. The bore has an o-ring defining an aperture configured for receiving and retaining the bulbous tip. Gill is limited by the method of attachment of the enhancer to the ring because the ability of the enhancer to be properly positioned is totally dependent on the o-ring to stem and bulb interface. Open o-ring interfaces are vulnerable to degradation of the elasticity, tearing, and becoming fouled with dirt over time. Further, while the security of the enhancer is at least partially improved by the position of the wearer's finger. The Gill configuration is stated as reducing the ring by one quarter of a size as a result of the enhancer being mounted on the inner surface of the ring.

A continuing need exists for an earring configured for easily attaching an ornamental accessory to the earring.

SUMMARY

An earring is described including a fastening mechanism. An accessory is configured for being removably positioned with the earring. An attachment mechanism is configured for connecting the earring and accessory. The attachment mechanism includes posts, catches, and bias means configured for joining the earring and accessory. The posts are positioned on the earring. The catches and bias means are positioned on the accessory. The catches and bias means are configured for receiving the posts.

The invention, together with attendant advantages, will be best understood by reference to the following detailed description of the invention when used in conjunction with the figures below.

BRIEF DESCRIPTION OF THE DRAWINGS

Preferred embodiments of the presently disclosed earring having an attachable accessory are described herein with reference to the drawings, wherein.

DETAILED DESCRIPTION OF THE EMBODIMENTS

Figure 1:
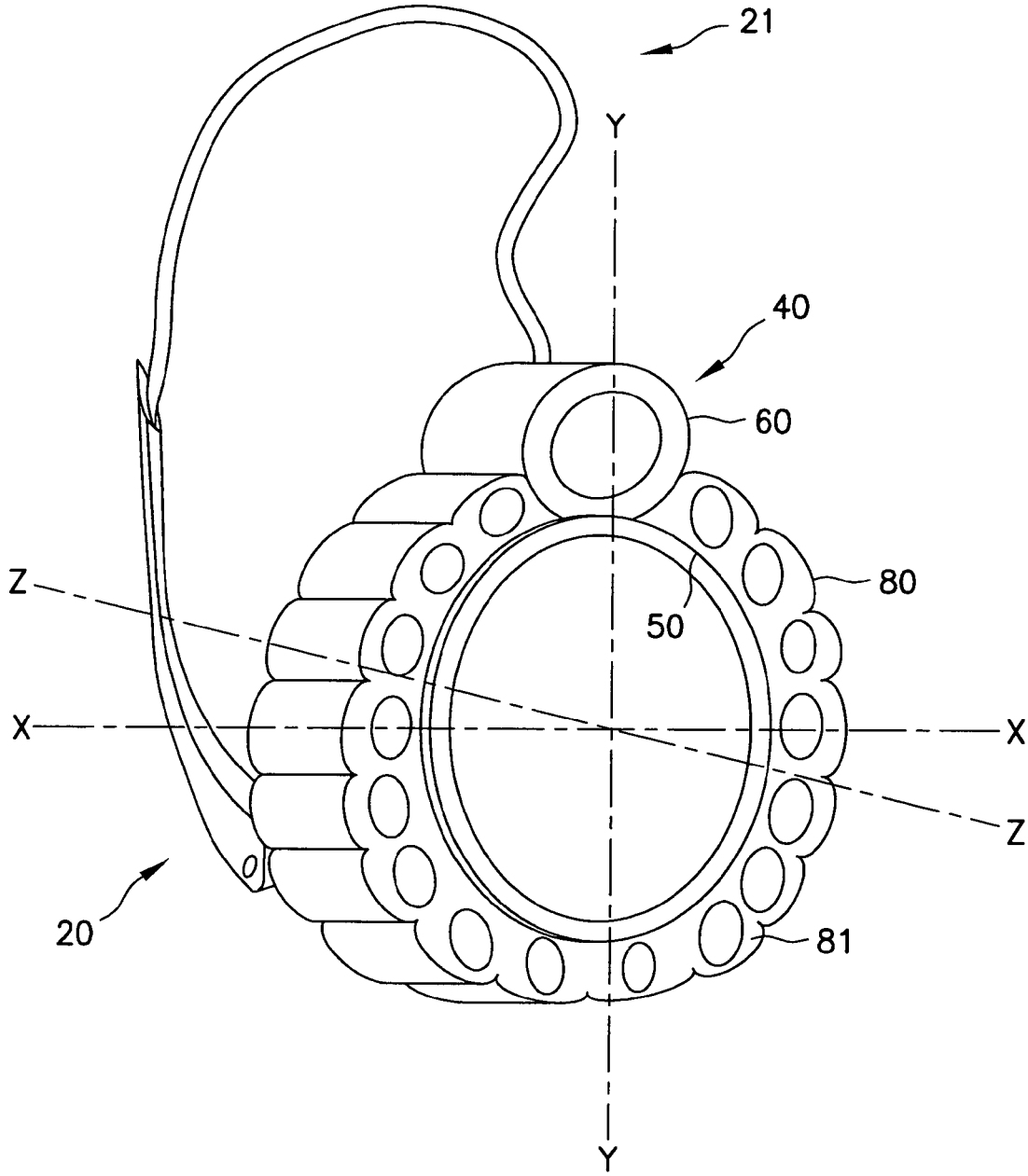
FIG. 1 is a frontal perspective view of a multiple configuration earring in a second position constructed in accordance with the present disclosure.

Referring now in specific detail to the drawings in which like referenced numerals identify similar or identical elements throughout the several views and initially to FIG. 1, a novel earring having an attachable accessory, or earring assembly 10, is shown including an earring 20 having a fastening mechanism 21 and an ornamental portion 40 and an accessory 80. Fastening mechanism 21 and ornamental portion 40 are fixedly connected. Accessory 80 is removably connected with ornamental portion 40. Earring assembly 10 defines an axis-X, an axis-Y, and an axis-Z. Fastening mechanism 21 is substantially positioned in a first plane defined by the intersection of axes Y and Z.

Figure 2A:
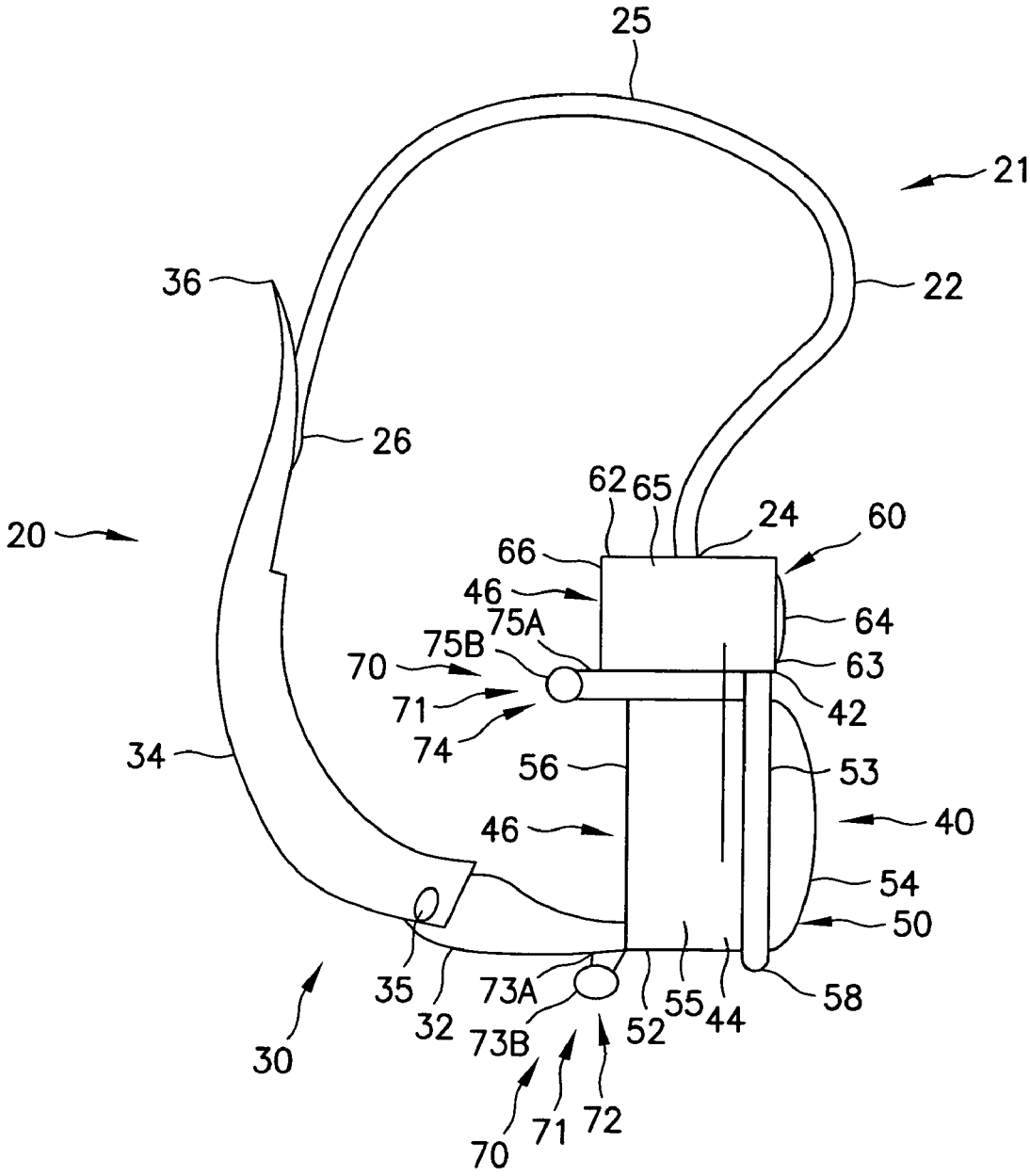
FIG. 2A is a side view of a first portion of the multiple configuration earring of FIG. 1 constructed in accordance with the present disclosure.
Figure 2B:
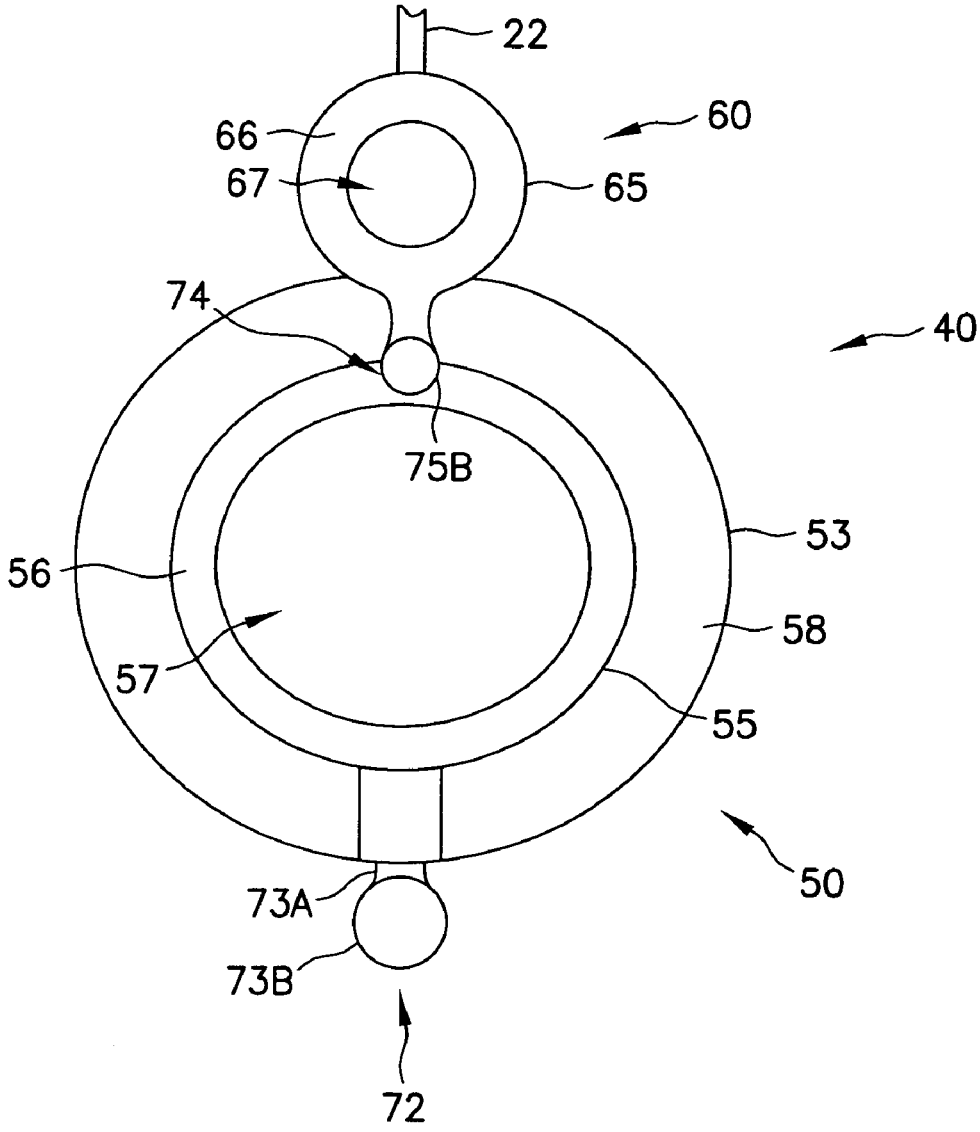
FIG. 2B is a back view of FIG. 2A with a fastening mechanism partially cut away.

As shown in FIGS. 1, 2A, and 2B, fastening mechanism 21 of earring 20 in one preferred embodiment includes a wire 22 having a first end 24 connected with ornamental portion 40 and a generally arcuate shape mid section 25 terminating in a tip 26. A hinged flange portion 30 includes a first arm 32 fixedly connecting ornamental portion 40 and a hinge 35. A second arm 34 is rotatingly connected to hinge 35. Second arm 34 is an elongate piece defining a concave channel and terminating in a tip 36 configured to receive tip 26. Second arm 34 is movable between a first position in direct contact with tip 26 and a second position wherein a gap is defined between tips 26 and tip 36 suitable for positioning or removing earring assembly 10 from an ear of a wearer.

Fastening mechanism 21 is secured in the first position by a biasing means positioned in the vicinity of hinge 35 or by a snap type friction connection between cylindrical tip 26 and the concave channel of tip 36. In this one preferred embodiment, tip 26 of wire 22 is adapted for positioning through a hole defined by a pierced ear of the wearer and is suspended from the pierced ear by arcuate mid portion 25 approximately centrally positioned between first end 24 and tip 26. It is also readily envisioned attachment mechanism 20 can be a post or non-pierced earring pressure device.

Ornamental portion 40 has a front 42, sides 44, and a back 46. First ornamental portion in this one preferred embodiment 40 includes a first ornamental portion 50 fixedly connected to a second ornamental portion 60. First end 25 of fastening mechanism 21 is connected to second ornamental portion 60. Arm 32 is connected to first ornamental portion 50. Ornamental portion 40 and fastening mechanism 21 define a selectively closeable loop.

First ornamental portion 50 includes a setting 52 and a jewel 54. Setting 52 has a cylindrical shape with a smooth outer surface 55. A circular rim 53 is defined on outer surface 55 that further includes a lip 58 extending radially from surface 55. Setting 52 has a front or face defining a hole 57 configured for receiving jewel 54. A back 56 of setting 52 can be a flat circular disc terminating hole 57 or a rim defining a through hole 57. Jewels as defined herein, include costume jewelry, precious stones, or ornamental designs on metals or metal alloys.

Second ornamental portion 60 includes a setting 62 and a jewel 64. Setting 62 has a cylindrical shape with a smooth outer surface 65. A simple circular rim 63 is defined on outer surface 65. Setting 62 has a front or face defining a hole 67 configured for receiving jewel 64. Setting 62 also includes a back 66 that can be a flat circular disk terminating hole 67 or a rim defining a through hole 67. Rim 63, in this one preferred embodiment, is smaller than rim 53 and the centers of rim 63 and rim 53 are aligned with axis-Y.

Ornamental portion 40 as shown including first portion 50 and second portion 60 in this one preferred embodiment, can also have a broad range of ornamental designs including a single stone positioned in a single setting, first portion 50 smaller than second portion 60, and varying setting surface treatments or shapes for example, as well as any other ornamental design arrangement suitable for use with attachment device 70 as described herein.

Attachment device 70 includes a system of posts 71, catch system 90, and bias means 96. Posts 71 are positioned on back 46. Posts 71 include a first post 72 and a second post 74. Post 72 and post 74 have cantilevered rods 73A and 75A and tips 73B and 75B, respectively. Tips 73B and 75B are configured as spherical balls, but tips 73B and 75B can also readily take the shape of a "T", for example, having suitable shape for attachment device 70. Post 72 is positioned in fixed spatial relation with a second post 74. First post 72 and second post 74 are positioned substantially in the first plane and are separated a suitable distance to provide a secure connection with accessory 80. In this one preferred embodiment, first post 72 is in juxtaposition with arm 32, aligned with the first plane, and extends at approximately a 45 degree angle between axes Y-Z. Second post 74 is positioned approximately at the junction between setting 52 and setting 62, extends generally parallel to axis-Z. Thus, ornamental portion 40 connects with fastening mechanism 21 to form a closeable loop. In addition, the combination of back 46 and posts 71 provides a suitable structural foundation for the integration of accessory 80.

Figure 3:
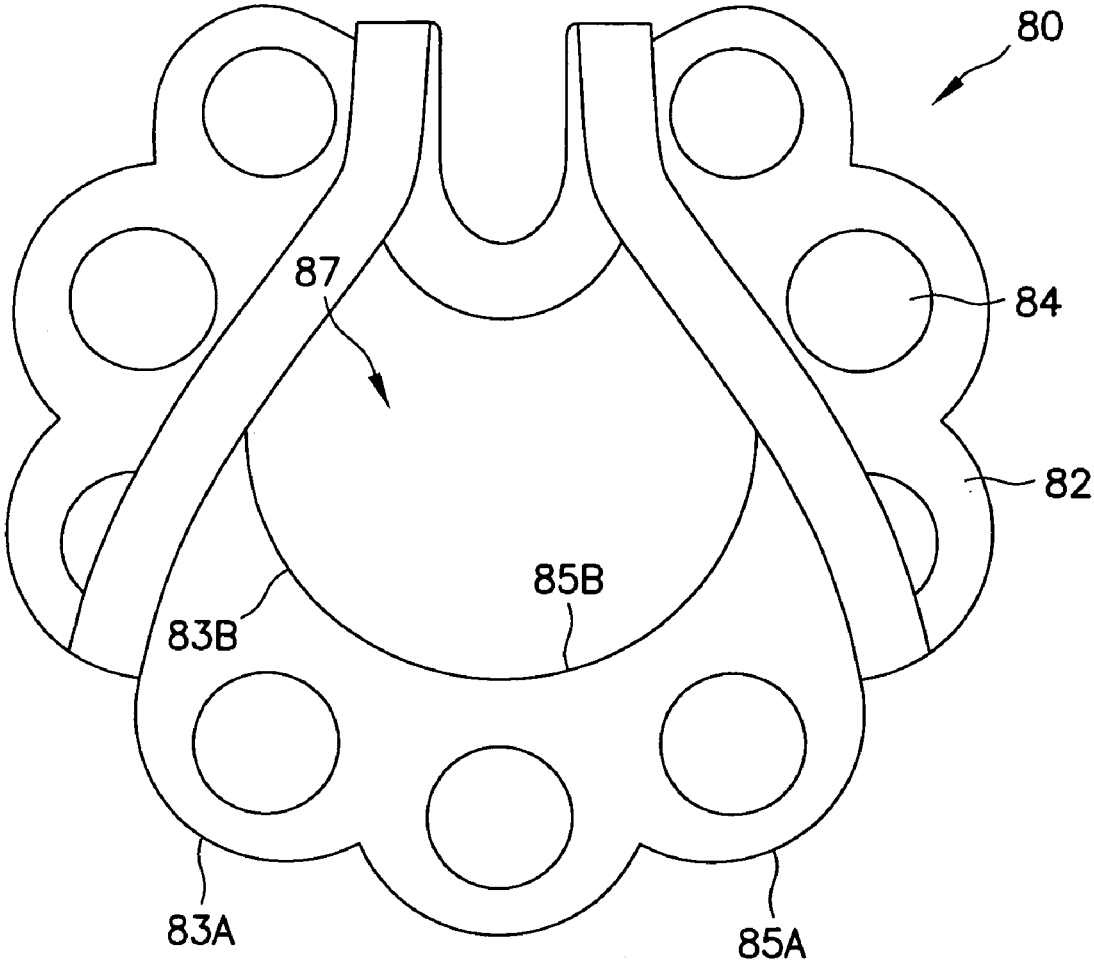
FIG. 3 is a back view of a second portion of the multiple configuration earring of FIG. 1 constructed in accordance with the present disclosure.

Referring now to FIGS. 1 and 3, accessory 80 has an annular shape and includes a setting 82 including a plurality of jewels 84 in this one preferred embodiment. Setting 82 has an interrupted annular shape having an outer arcuate surface 85A, an arcuate inner surface 85B, ends 85C, and a back 86 (see FIG. 4B). Outer surface 85A includes ornamental arcuate undulations in this one preferred embodiment. Inner surface 85B can include ornamental or smooth surfaces, but is configured to correspondingly mate with outer surface 55 of first portion 50 (see FIGS. 2A and 2B). Similarly, ends 85C are configured to correspondingly mate with outer surface 65 of second portion 60. Setting 82 similarly defines an outer annular rim 83A and an inner annular rim 83B. Inner rim 83B and inner surface 85B define a through hole 87. Setting 82 has a front or face 81 defining a plurality of holes 89 configured for receiving the plurality of jewels 84.

Catch system 90 includes a first catch 92, second catch 94, and biasing means 96. First catch 92 and second catch 94 are positioned for receiving first post 72 and second post 74, respectively. Catch 92 is an arcuate notch defined in back 86 of accessory 80 configured for receiving at least circular portion 73A. Catch 94 is connected to ends 85C and has a flange shape defining a slot 93 configured for receiving first post 72. The distance between ends 85C is configured for receiving outer surface 65 of second ornamental portion 60.

Biasing means 96 includes two wire members 97 and 98. Wire members 97 and 98 are mirror images symmetrical about axis-Y and include first ends 97A and 98A positioned at opposing points on back 86 in the vicinity of outside edge 85A. Wires 97 and 98 have mid portions 97B and 98B crossing over portions of hole 87 as chords across the substantially circular shape of arcuate inner rim 83B. Wires 97 and 98 mid portions 97B and 98B as well as end portions 97C and 98C are positioned for direct contact with backs 56 and 66 of first and second portions 50 and 60, respectively. Wires 97 and 98 have second ends 97D and 98D connecting with catch 94.

Catch system 90 of accessory 80 and post system 70 of earring assembly 20 secure earring assembly 10 together by a combination of interlocking post system 71 with catch system 90 and the biasing of inner annular rim 83B into the back side of lip 58 of first ornamental portion 50.

Figure 4A:
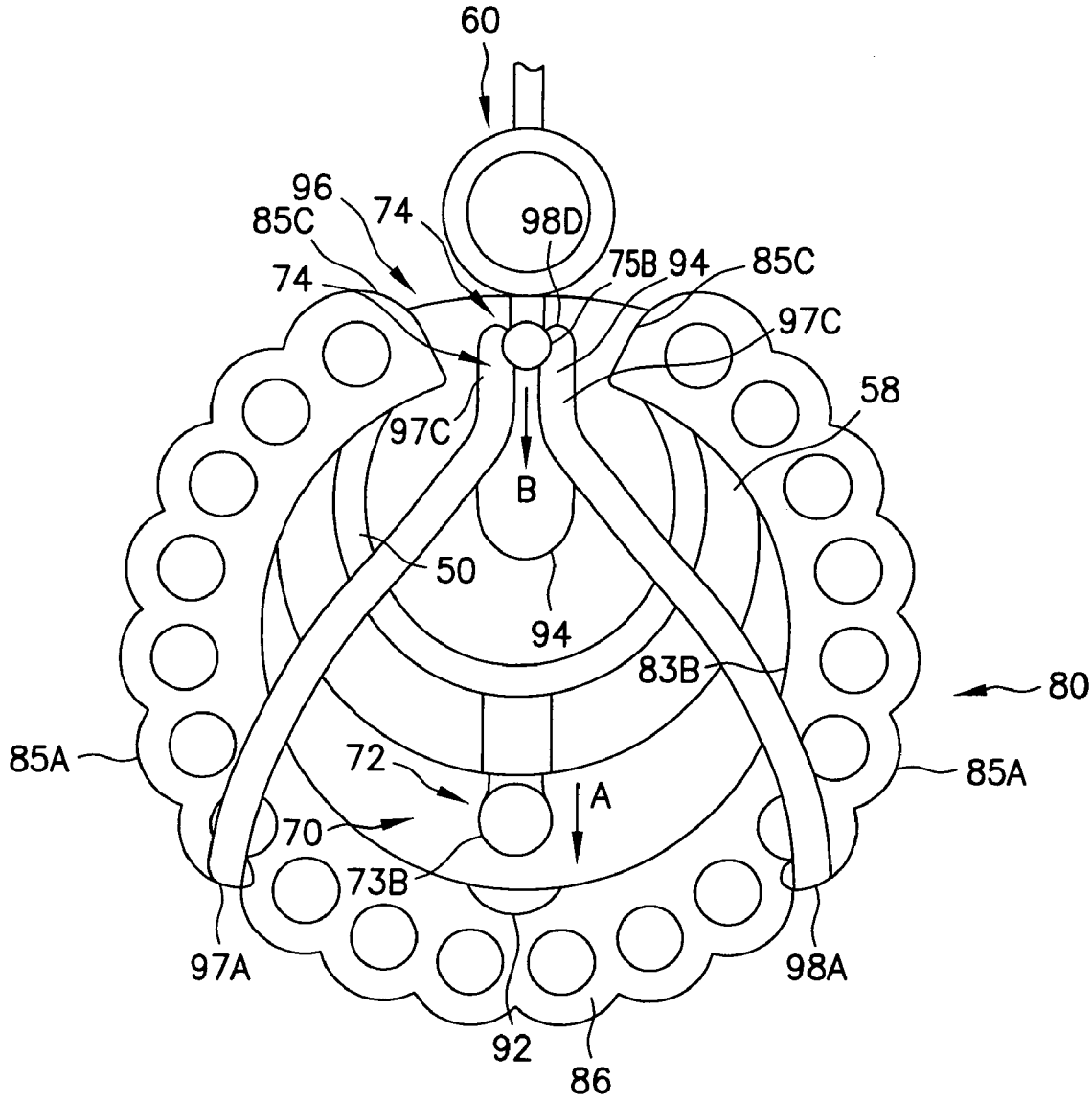
FIG. 4A is a back view of the multiple configuration earring of FIG. 1 entering into the second position from a first position with the fastening mechanism partially cut away.
Figure 4B:
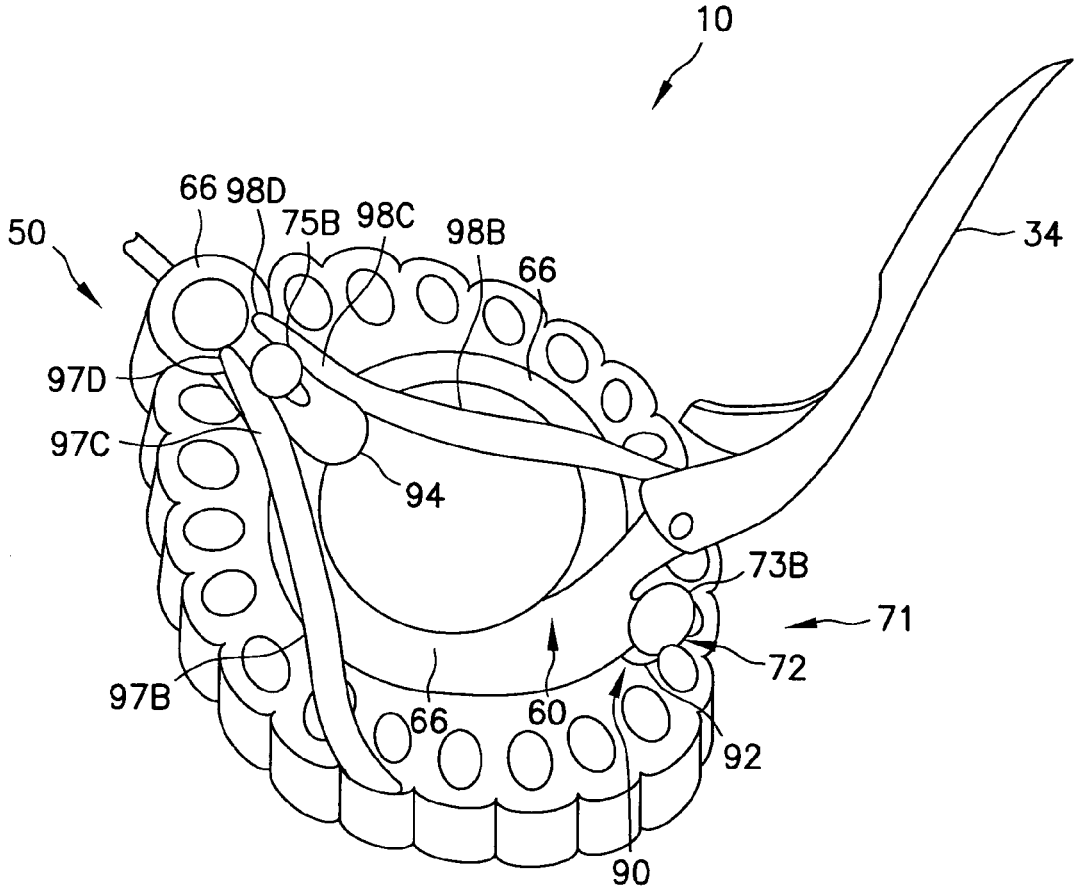
FIG. 4B is a back perspective view of the multiple configuration earring of FIG. 1.

In operation, as shown in FIGS. 1, 4A, and 4B, first portion 40 and accessory 80 are joined by a simple one step process. Attachment mechanism 20 is fully opened and arm 34 is positioned through hole 87 of accessory 80. Cantilevered rod 75A (see FIG. 2A) is positioned in notch 95 of catch 94 and end portions 97C and 98C are positioned under tip 75B of catch 74 and tip 75B is moved in the direction of arrow-B to secure accessory 80 in position. Simultaneously, spherical tip 73B of catch 72 is positioned in arcuate notch of catch 92 as shown by arrow-A. Face 81 and arcuate inner rim 83B of accessory 80 abut against the back side of lip 58 of first ornamental portion 50 and are held in position by the combination of the positioning of end portions 97C and 98C between back 66 of second ornamental portion 60 and spherical tip 75B, the contact of mid portions 97B and 98B on back 56 of first ornamental portion 50, and the positioning of tip 73B in catch 74. Accessory 80 is removed from first portion 40 by the reversal of the above step.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure.

What is claimed is:

1. An earring assembly comprising:

a fastening mechanism having an open position and a closed position;

an ornamental portion coupled to said fastening mechanism and having an outer surface, a front side, a back side and a rim defined on the outer surface that further includes a lip extending radially from the ornamental portion;

an accessory removably connected to said ornamental portion, said accessory defining a front side, a back side, and an inner rim, said accessory having an opening traversing from the front side to the back side, the opening having an inner surface, the opening and the inner surface being configured for mating with at least a portion of the ornamental portion, and whereby the inner rim abuts against the back side of the lip; and attachment means for attaching the accessory to the ornamental portion, the attachment means including:

(a) a biasing means being positioned on the accessory and the ornamental portion; and (b) a system of catches and posts, the system of catches and posts being positioned on the accessory and the back side of the ornamental portion, the catches including a first notch and a second notch, the posts including a first and second rod and a first and second tip, whereby when the fastening mechanism is in the open position, the opening of the accessory is positioned over the fastening mechanism and a portion of the accessory is positioned on the back side of the ornamental portion thereby allowing the first notch to be received by the first rod and the first tip and the second notch to be received by the second rod and the second tip.

2. The earring assembly of claim 1 wherein the fastening mechanism includes an upper arm, a lower arm and a flange, said flange is coupled to the ornamental portion and said lower arm is rotatably coupled to the flange via a hinge.

3. The earring assembly of claim 2 wherein the lower arm of the fastening mechanism is positioned through the opening of the accessory for attachment of the accessory to the ornamental portion.

4. The earring assembly of claim 2 wherein the upper arm of the fastening mechanism has a substantially arcuate shape and terminates at a tip.

5. The earring assembly of claim 4 wherein the lower arm is elongated piece defining a concave channel having a terminating tip, said terminating tip of the lower arm is configured to receive the terminating tip of the upper arm.

6. The earring assembly of claim 1 wherein the ornamental portion and the fastening mechanism define a selectively closed loop.

7. The earring assembly of claim 1 wherein the removable accessory has a plurality of spaced apart settings within the circumference of its annular shape.

8. The earring assembly of claim 1 further comprising a second ornamental portion coupled to the ornamental portion, said second ornamental portion has a frontal face defining a hole and is adapted to receive a jewel.

9. The earring assembly of claim 1 wherein said ornamental portion has frontal face defining a hole adapted for receiving a jewel.

10. An earring assembly comprising:

(a) an earring assembly having a first portion wherein the earring assembly includes a fastening mechanism having an open position and a closed position and an ornamental portion, said ornamental portion having a back side and a rim defined on an outer surface that further includes a lip extending radially from the ornamental portion; and (b) a second portion of the earring assembly wherein the earring assembly further includes a removable annular shaped accessory having a plurality of spaced apart settings, an inner rim and a hole within its circumference, the hole traversing a cross-sectional diameter of the second portion, said accessory being connected to the ornamental portion and having a configuration suitable for at least partially receiving the ornamental portion, the ornamental portion having posts on a back-side portion of the ornamental portion and the accessory having catches configured for receiving the posts, the accessory further including biasing means configured for connecting with at least one of the posts and a back of the ornamental portion, and whereby the inner rim abuts against the back side of the lip, wherein the catches include a first catch having a first notch and a second catch having a second notch, the posts including a first post having a first rod and a first tip and a second post having a second rod and a second tip, whereby when the fastening mechanism is in the open position the opening of the accessory is positioned over the fastening mechanism and a portion of the accessory is positioned on the back side of the ornamental portion thereby allowing the first notch to be received by the first tip of the first post and the second notch to be received by the second rod of the second post.

11. The earring assembly of claim 10 wherein the fastening mechanism includes an upper arm, a lower arm and a flange, said flange is coupled to the ornamental portion and said lower arm is rotatably coupled to the flange via a hinge.

12. The earring assembly of claim 11 wherein the lower arm of the fastening mechanism is positioned through the opening of the accessory for attachment of the accessory to the ornamental portion.

13. The earring assembly of claim 11 wherein the upper arm of the fastening mechanism has a substantially arcuate shape and terminates at a tip.

14. The earring assembly of claim 11 wherein the lower arm is elongated piece defining a concave channel having a terminating tip, said terminating tip of the lower arm is configured to receive the terminating tip of the upper arm.

15. The earring assembly of claim 10 wherein the ornamental portion and the fastening mechanism define a selectively closed loop.

16. The earring assembly of claim 10 wherein the removable accessory has a plurality of spaced apart settings within the circumference of its annular shape.

17. The earring assembly of claim 10 further comprising a second ornamental portion coupled to the ornamental portion, said second ornamental portion has a frontal face defining a hole and is adapted to receive a jewel.

* * * * *